United States Patent [19]

Fleissner

[11] 3,943,734

[45] Mar. 16, 1976

[54] APPARATUS FOR THE CONTINUOUS TREATMENT OF TEXTILE MATERIAL

[75] Inventor: Heinz Fleissner, Egelsbach near Frankfurt am Main, Germany

[73] Assignee: Vepa AG, Basel, Switzerland

[22] Filed: Apr. 29, 1974

[21] Appl. No.: 465,346

Related U.S. Application Data

[60] Division of Ser. No. 352,348, April 18, 1973, Pat. No. 3,835,490, which is a continuation of Ser. No. 13,988, Feb. 25, 1970, abandoned, which is a continuation-in-part of Ser. No. 831,952, June 10, 1969, abandoned.

[30] Foreign Application Priority Data

Feb. 26, 1969 Germany ..... 1909646
Jan. 31, 1970 Germany ..... 2004390

[52] U.S. Cl. ..... 68/5 D; 68/DIG. 5; 68/19.1; 68/20; 68/22 R; 68/22 B

[51] Int. Cl.[2] ..... D06B 3/02; D06B 21/00

[58] Field of Search ..... 68/5 D, 5 E, 19.1, 20, 68/22 R, 22 B, DIG. 5; 34/115, 122

[56] References Cited

UNITED STATES PATENTS

| | | | |
|---|---|---|---|
| 2,785,042 | 3/1957 | Grajeck et al. | 68/22 B X |
| 3,124,429 | 3/1964 | Alexeff et al. | 68/51 D X |
| 3,242,702 | 3/1966 | Fleissner | 68/DIG. 5 |
| 3,318,013 | 5/1967 | Erb | 68/5 D X |
| 3,608,109 | 9/1971 | Fleissner et al. | 68/DIG. 5 |

FOREIGN PATENTS OR APPLICATIONS

| | | | |
|---|---|---|---|
| 1,550,167 | 11/1968 | France | 68/5 D |

*Primary Examiner*—Daniel Blum
*Assistant Examiner*—Philip R. Coe
*Attorney, Agent, or Firm*—Craig & Antonelli

[57] ABSTRACT

The present disclosure is directed to an apparatus for the continuous treatment of fibrous and thread-like materials in the form of slivers, roving or fibrous ribbon wherein uniform treatment, for example, uniform dye application and uniform setting of the dyestuff is effectively achieved.

12 Claims, 2 Drawing Figures

APPARATUS FOR THE CONTINUOUS TREATMENT OF TEXTILE MATERIAL

This application is a division of application Ser. No. 352,348, filed Apr. 18, 1973 and now U.S. Pat. No. 3,835,490, which is in turn a continuation of application Ser. No. 13,988 filed Feb. 25, 1970 and now abandoned, which is in turn a continuation-in-part of application Ser. No. 831,952, filed June 10, 1969 and now abandoned.

BACKGROUND OF THE INVENTION

The present invention relates to an apparatus for the continuous treatment, particularly dyeing, of textile materials, preferably fibrous and thread-like materials, for example, synthetic fibers, such as polyester and polyamide fibers. According to the present invention the materials to be treated are continuously conveyed through several treatment steps, such as, for example, impregnating and/or printing the textile material with a dyestuff, setting the dyestuff, utilizing a temperature treatment compatible with the fiber being treated, such as for example, steaming the material in saturated steam, or thermosoling the material at a temperature of about 170°–230° C. utilizing air, wherein the treatment medium is conducted in each case through the material by means of a suction draft. Finally, the textile material is washed and dried.

The parent application relates to an apparatus consisting of several devices wherein, due to the use of said devices and the construction thereof, it is not only suitable for the continuous treatment of woven and knitted goods, cables and combed yarns by the thermosol process, but it is also suitable for the treatment of said materials in a saturated steam atmosphere. Furthermore, it is effective for treating loose fibrous materials, such as for example, cotton flock for the purpose of continuously bleaching or dyeing said material. This apparatus and the individual devices required therefor present an effective arrangement for the efficient management and reduction in the necessary capital outlay for the treatment of textile fibers.

In addition to the above-mentioned textiles, it is also conventional to dye yarn in the form of strands or spools in a discontinuous manner. It has also been suggested to dye and/or print yarns in a continuous fashion. In this process, a plurality of yarn threads pass through the individual treatment units and are thereafter wound up again. However, in the continuous dyeing of yarns, it is difficult to apply the dyestuffs uniformly to the individual fibers and to attain a uniform setting throughout. Also some difficulties are encountered in washing the dyed, twisted yarns satisfactorily. A deficient setting (fixing) and washing process produces a lower rubbing resistance (fastness to rubbing) in the fabric.

SUMMARY OF THE INVENTION

An object of the present invention is to avoid the prior art disadvantages in the continuous treatment of textile materials.

Another object of the present invention is to provide an improved apparatus for the continuous treatment of textile materials, for example, fibrous and thread-like materials in the form of slivers, roving or fibrous ribbon.

A further object of the present invention is to provide an improved process and apparatus for dyeing fibrous and thread-like materials, and to render the utilization of the apparatus suggested in the parent application even more versatile.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within with spirit and scope of the invention will become apparent to those skilled in the art from this detailed description.

Pursuant to the present invention, it has been found that the above-mentioned disadvantages may be eliminated and a much improved apparatus for the continuous treatment of textile materials may be obtained by providing that the fibrous and thread-like materials are subjected to the dyeing and/or printing treatment not in the form of a yarn, but rather in the form of a sliver, or as a roving or fibrous ribbon (slubbing) in case of endless synthetic threads.

Conducting the dyeing step with untwisted material affords the advantage that it is now possible to apply the dyestuffs flawlessly and uniformly and to effect a substantially more uniform setting and washing treatment, since the respective treatment media can now flow around the individual threads in the loose fiber arrangement. Similarly, as is known in the continuous yarn dyeing method, it is also advantageous in this instance to treat a plurality of such slivers, or rovings or fibrous ribbons continuously, combining them into the shape of a fibrous web.

In order to be able to set a large amount of material in a space-saving arrangement, it is suggested to heat the sliver and the like, after the dyestuff application, to the setting temperature and then to place this material into folds (pleats) and expose it in this folded condition to at least the dyestuff setting treatment. Depending on the washing and drying elements employed, this folded condition can also be retained during the washing and drying stages of the process. Heating the sliver to the setting temperature prior to folding has the advantage that it makes a comletely uniform and shock-like (sudden) heating possible. In many cases, it is advantageous to remove the folded condition after the setting treatment and prior to the washing or drying step, and to subject the slivers and the like to the additional treatments, for example washing and drying, in the form of a web. In this connection, it is important that the treatments take place without tensioning (stretching). This is readily possible when the process is conducted on so-called sieve drum washing machines and sieve drum dryers, or also on perforated belt washing machines and perforated belt dryers.

The apparatus for conducting the above-mentioned treatment according to the present invention advantageously comprises the following individual elements:

A draw-off device for drawing material from spools, coils, or from cans, and for combining a plurality of slivers, rovings, or fibrous ribbons into a web;

a dye application device, for example a padder, suitable for this purpose and/or a printing device. A typical padder which can be used is, for example, a wedge padder;

a setting unit, for example, a steaming device;

a washing device which can comprise, for example, several treatment baths, each provided with a sieve drum;

a drying unit, especially a sieve drum dryer;

a depositing or windup device; it is advantageous, in this connection, to wind up the individual slivers in each case individually; and a common control device for the above-mentioned units.

It is suggested to employ, as the setting unit, a perforated belt steamer with at least one sieve drum subjected to a suction draft, said sieve drum being disposed in front of the perforated belt.

A particular advantage of the apparatus of the present invention is that is can be utilized for all of the known textile fibers for the optimum treatment thereof. Synthetic fibers, such as polyacrylic fibers or polyacrylonitrile fibers, and natural fibers such as wool, cotton, or cellulose-base fibers are treated under saturated steam conditions at about 100°–102° C. This treatment effects the setting of the dyes disposed thereon, or the bleaching of the fibers by means of bleaching agents added thereto. In order to obtain a sufficient setting of the colors, and especially for the bleaching process, a longer dwell time of the textile material in the treatment chamber is necessary. The duration of this residence time extends from about 3–20 minutes. In contrast thereto, polyester fiber is treated in accordance with conventional thermosol method, for which purpose a temperature of above about 170° C., preferably 190°–210° C. must be maintained in the treatment chamber. As the treatment medium, air or superheated steam can be employed. The residence time can be from 20 seconds up to about 1 minute. In addition to polyester fiber, polyacrylic fiber can also be treated by means of the thermosol process.

This apparatus, which is insulated with respect to the outside air, and the inlet and outlet of which are sealed against the outside atmosphere, for example, by means of a pair of inlet rolls and outlet rolls, can also provide, as seen in the conveying direction of the materials, several sieve drums disposed in series, the material being treated alternatingly contacting said sieve drums. On these sieve drums, the textile material is exposed to an intensive throughflow of the treatment medium, which heats up the material in a shock-like fashion. The penetration of the textile material by the treatment medium is effected on both sides of the material as it is alternately conveyed on the surface of the sieve drum means. An endless conveyor belt follows this unit, on which belt the textile material is conveyed in the folded condition through the remaining length of the device either rapidly or slowly, depending on the necessary residence time.

By means of an additional feature of the present invention, the setting unit can be improved in its construction so that it is even more economical and possesses even greater versatility in its utilization. According to the present invention, this is attained by providing that the conveyor belt extends from the outlet through the steam chamber to the inlet, but beneath the sieve drums which are arranged in series at the inlet. By means of this feature, it is possible to expose the fibrous material to the treatment medium either for a longer or shorter period of time without changing the construction of the setting device, and the rotational speeds of the sieve drums and the conveyor belt. In case the conveyor belt extends to the inlet beneath the sieve drums, for example, beneath drums disposed in a side-by-side relationship, the textile material is either guided on the surface of only the first sieve drum, depending upon the requirements, or on the surface of all of the sieve drums. In the former situation, the fibrous material passes over only the first drum and then is transferred to the perforated belt disposed therebelow, if desired in a folded condition. In this situation, the fans producing the vacuum within the subsequent sieve drums would have to be switched off. Since the perforated belt is operated at a slower conveying speed when compared to the sieve drums, the textile material thus remains in the setting unit for a longer period of time. In case it is unnecessary for the textile fibers to remain in the setting unit for a longer period of time, which is particularly applicable in connection with the thermosol treatment of polyester fibers, the fibrous material is transported, alternatingly, over the surface of one of the series-connected sieve drums, thus over-shooting and undershooting the drums. The textile material is thereby deposited onto the conveyor belt by only the last drum, from the top in the downward direction. The material thus remains on the belt only for a short length and for a short time.

BRIEF DESCRIPTION OF THE DRAWINGS

These and further features, advantages and objects of the present invention will become more apparent from the following description when taken in conjunction with the accompanying drawings which show, for purposes of illustration only, and wherein.

DETAILED DESCRIPTION OF THE DRAWINGS

Figure 1:
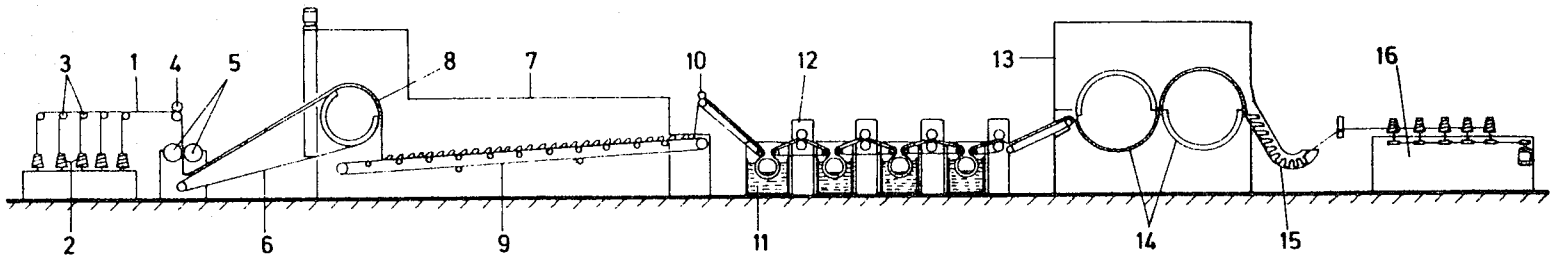
FIG. 1 is a sectional view of an apparatus for the treatment of sliver or roving in accordance with the present invention.

Referring now to the drawings and, in particular to FIG. 1, the slivers 1 are drawn off the spools 2 and fed, via a roller conveyor 3 as well as a pair of draw (feed) rolls 4, to a wedge padder (nip padder) 5. The slivers rovings, and the like impregnated with dye liquor then pass to a conveyor belt 6 and into a steaming device 7. The steaming device consists of a sieve drum 8 subjected to a suction draft, and a conveyor belt 9. The conveyor belt 6 is fashioned as a perforated belt and is extended around the sieve drum 8. The slivers 1 are heated to the setting temperature on the sieve drum 8 and then, radially buckled so that they are in a pleated condition when deposited on the perforated belt 9. A pair of draw-off rolls 10 are disposed at the end of the steaming unit 7, to take up the pleats. Thereafter, the slivers and the like are washed out on sieve drum washing baths 11 provided with presses 12 disposed therebehind. A sieve drum dryer 13 containing sieve drums 14 subjected to a suction draft serves for drying the material. This sieve drum dryer 13 is provided with a chute 15 at the outlet thereof, said chute being fashioned as a dwell trough. From the dwell trough, the slivers 1 are fed to a windup device 16 where the individual slivers are again wound up.

Such units can effectively operate with 150 meters, and more. Depending on the number of slivers, these devices exhibit operating widths of up to about 1,200 to 1,800 mm., or even more.

FIG. 1 also illustrates the common control device 25 which controls each of the heretofore described individual units of the apparatus.

Figure 2:
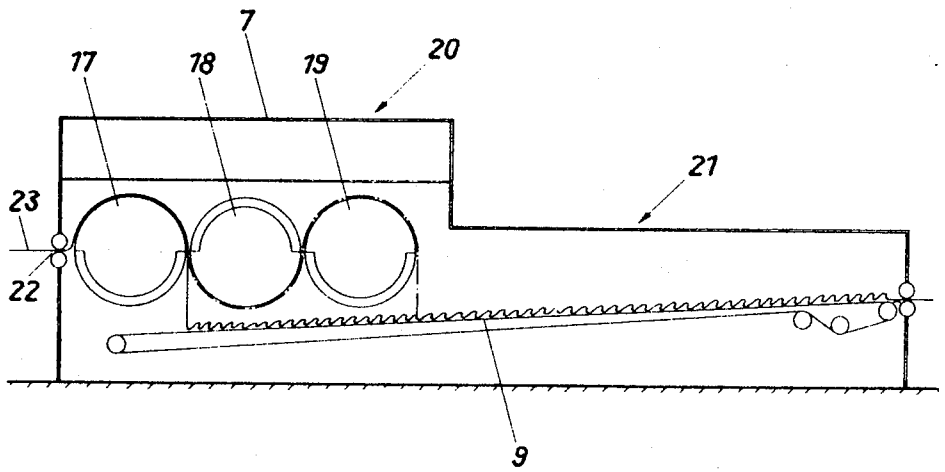
FIG. 2 shows another embodiment of the setting device used in the system of FIG. 1.

The setting device according to FIG. 2 consists of a heating section denoted by 20 and a residence (dwell) section denoted by 21. The heating section consists essentially of three series-disposed sieve drums 17 through 19 which convey the textile material 23, fed from the outside through an inlet 22 into the heat-insulated housing 7, through the heating section 20 so that the material alternatingly overshoots and undershoots the drums. Each of the three sieve drums 17 through 19 is conventionally associated with fans (not illustrated) which create a suction draft within the sieve drum. The treatment medium which is drawn into the sieve drum is recycled back to the outer surface of the sieve drum by way of regenerating or heating units, which are likewise not illustrated. The heating units can be disposed anywhere in the circulation zone of the treatment medium.

Once the fibrous material is sufficiently heated, it is passed from the top downwardly to the perforated belt 9 disposed underneath the sieve drums. The perforated belt 9 extends along the entire length of the device, i.e., along the heating section as well as through the residence section. Because of this feature, and with the fans of sieve drums 18 and 19 being switched off, the textile material can be deposited from the first sieve drum 17 onto the conveyor belt 9, also in pleats. The residence time on the conveyor belt 9, which has a slower conveying speed when compared to the sieve drums, is necessary, especially when conducting the steaming step under a normal atmosphere, i.e., under saturated steam when treating various synthetic and natural fibers.

In case the illustrated apparatus is to be employed for thermosoling, for example, polyester fibers, the textile material passes over all three sieve drums 17 through 19, alternatingly overshooting and undershooting the same. The material is then transferred to the conveyor belt 9, the speed of which can be optionally increased, only by the last sieve drum 19. Consequently, although the residence time can be considerably shorter, the advantage of subjecting the textile material intensively to the treatment medium, by the suction draft with alternating contact on the sieve drum surface, can be exploited.

The material which can be treated by the apparatus of the present invention include any of the natural or synthetic fibers. The natural fibers can include cotton, wool, silk, cellulose, etc., and the synthetic fibers may comprise synthetic polymers such as polyolefins, e.g., polyethylene, polypropylene, etc. polyamides, e.g., Nylon 6 obtained by the condensation of caprolactam, Nylon 66 obtained by the condensation of hexamethylenediamine with adipic acid, etc., polyesters, e.g., polyethlene terephthlate, etc., phenolic resins, e.g., phenol formaldehyde resins, urea formaldehyde resins, etc., polyvinyl materials, e.g., polyvinyl chloride, polyvinyl acetate, etc., and acrylate resins, such as e.g. polymethymethacrylate. Copolymers of these materials with one another or with ethylenically unsaturated monomers, and similar type polymers are also encompassed by the present invention. The present invention is also applicable to blends of the above-mentioned textile materials.

The invention being thus described, it will be obvious that the same may be varied in many ways. Such variations are not to be regarded as a departure from the spirit and scope of the invention, and all such modifications as would be apparent to one skilled in the art are intended to be included.

What is claimed is:

1. An apparatus for the treatment of textile material which comprises, in combination, impregnating means, inlet means for introducing a plurality of slivers in the form of a web to the impregnating means, a drying and fixing chamber having a heating section at an inlet end and a dwell section at an outlet end, said chamber containing a plurality of sieve drum means arranged in series and subjected to a suction draft within said heating section and a perforated conveyor belt means disposed below the first one of said plurality of sieve drum means and extending from the inlet end to the outlet end of said chamber, means for conveying the material being treated from the impregnating means to the first sieve drum means in the drying and fixing chamber, washing means comprising at least one sieve drum wash bowl disposed behind the drying and fixing chamber, each of said sieve drum wash bowls having a pair of squeeze rollers for squeezing textile material exiting therefrom, means for conveying the material from the drying and fixing chamber to the washing means, dryer means containing at least one sieve drum means subjected to a suction draft, means for conveying the material from the washing means to the dryer means, outlet means for removing the material from the dryer means and a common control device for operating the individual units of said apparatus.

2. The apparatus of claim 1, wherein the inlet means comprises a plurality of spools for storing said slivers, a roller conveyor for guiding slivers from said spools and a pair of feed rollers for introducing the slivers to said impregnating means.

3. The apparatus of claim 1, wherein the impregnating means is a wedge padder.

4. An apparatus for the treatment of textile material which comprises, in combination, impregnating means, inlet means for introducing a plurality of slivers in the form of a web to the impregnating means, a drying and fixing chamber having an inlet and outlet end, said chamber containing at least one sieve drum means subjected to a suction draft and a conveyor belt means disposed below the sieve drum means and extending from the inlet end to the outlet end of said chamber, means for conveying the material being treated from the impregnating means to the sieve drum means in the drying and fixing chamber, washing means comprising at least one sieve drum wash bowl disposed behind the drying and fixing chamber, each of said sieve drum wash bowls having a pair of squeeze rollers for squeezing textile material exiting therefrom, means for conveying the material from the drying and fixing chamber to the washing means, dryer means containing at least one sieve drum means subjected to a suction draft, means for conveying the material from the washing means to the dryer means, outlet means for removing the material from the dryer means and a common control device for operating the individual units of said apparatus, said means for conveying the material being treated from the impregnating means to the sieve drum means in the drying and fixing chamber comprising a conveyor belt, one end of which is disposed below the impregnating means and the other end extending into the drying and fixing chamber around the first one of the at least one sieve drum means within said drying and fixing chamber.

5. The apparatus of claim 1, wherein the drying and fixing chamber contains a plurality of odd-number sieve drum means disposed in said series relationship at the inlet end of the chamber and the material being treated is introduced to an upper portion of the first one of the odd-number sieve drum means.

6. The apparatus of claim 5, wherein the material being treated can be selectively deposited onto the perforated conveyor belt means from the first of the odd-number sieve drum means by controlling the suction draft in the remaining subsequent sieve drum means.

7. The apparatus of claim 6, wherein the first of said odd-number sieve drum means forms pleats in the textile material whereby said material is deposited onto said perforated conveyor belt means in the form of pleats, and draw-off rolls are provided above the perforated conveyor belt means at the outlet end of the drying and fixing chamber to remove the pleats from the material.

8. The apparatus of claim 1, wherein the outlet means comprises a dwell chute and a plurality of windup means for withdrawing slivers of the material from said dwell chute.

9. The apparatus of claim 1, wherein said control means includes means for selectively shutting off the suction draft of the sieve means other than the first sieve drum means within said heating section whereby the residence time of the textile material within said chamber can be exposed to a treatment medium within said chamber for a longer or a shorter period of time by directing the textile material over the first sieve drum means and then directly onto the perforated conveyor belt means or by directing the textile material over a plurality of sieve drum means and then onto the perforated conveyor belt means, respectively.

10. An apparatus for the treatment of textile material which comprises, in combination, impregnating means, inlet means for introducing a plurality of slivers in the form of a web to the impregnating means, a drying and fixing chamber having a heating section at an inlet end and a dwell section at an outlet end, said chamber containing a plurality of sieve drum means arranged in series and subjected to a suction draft within said heating section and a perforated conveyor belt means disposed below the first one of said plurality of sieve drum means and extending from the inlet end to the outlet end of said chamber and means for conveying the material being treated from the impregnating means to the first sieve drum means in the drying and fixing chamber.

11. The apparatus of claim 10, wherein said means for conveying the material from the impregnating means to the first sieve drum means in the drying and fixing chamber is arranged to introduce the textile material to an upper portion of the first sieve drum means.

12. The apparatus of claim 11, further comprising means for selectively controlling the suction draft in the sieve drum means within the heating chamber whereby the textile material being treated can be selectively deposited onto the perforated conveyor belt means from the first sieve drum means by shutting off the suction draft in the remaining subsequent sieve drum means and whereby the residence time of the textile material on said perforated belt means is greater.

* * * * *